United States Patent [19]

Chih

[11] Patent Number: 5,004,444

[45] Date of Patent: Apr. 2, 1991

[54] TOY SUBMACHINE GUN

[76] Inventor: Hsieh C. Chih, 8F.-5, No. 140, Min Chuan East Rd., Taipei, Taiwan

[21] Appl. No.: 391,753

[22] Filed: Aug. 9, 1989

[51] Int. Cl.[5] ..... A63H 5/04

[52] U.S. Cl. ..... 446/406; 446/473

[58] Field of Search ..... 446/405, 406, 407, 473, 446/401, 144, 418, 420

[56] References Cited

U.S. PATENT DOCUMENTS

| | | | |
|---|---|---|---|
| 3,010,718 | 11/1961 | Pearson, Jr. | 446/405 X |
| 3,015,186 | 1/1962 | Cook | 446/406 |
| 3,032,924 | 5/1962 | Carver | 446/406 |
| 4,808,143 | 2/1989 | Kuo | 446/406 |

*Primary Examiner*—Mickey Yu

*Attorney, Agent, or Firm*—Varndell Legal Group

[57] ABSTRACT

A toy submachine gun is provided. The toy submachine gun includes a body housing having a magazine housing and a pistol grip, a trigger, a plate spring, and a contact contacting with the plate spring. When the trigger is squeezed, a motor, a reduction gear assembly drives a rotating arm having an eccentrical shaft reciprocatingly which is guided within groove provided in the body housing, and also a striking plate spring engages with the rotating arm so that when it is released therefrom it will strike a sound box sound. A casing is reciprocatingly mounted on the body housing and receives the eccentrical shaft. The reduction gear assembly, the rotating arm, the sound box and the striking plate spring are mounted in the casing, so as to provide an enhanced vibrating feeling to the user of the gun by the reciprocal motion thereof.

4 Claims, 3 Drawing Sheets

TOY SUBMACHINE GUN

BACKGROUND OF THE INVENTION

The present invention relates to a toy and more particularly, to a toy submachine gun.

The present toy guns can be roughly categorized into the following three types:

(1) The electronic guns are capable of making sparks and sounds, but are of less interest for other children.

(2) The gunpowder-loaded guns have an appearance similar to that of the real guns and provide a loud sound, a gunpowder smell and smoke when triggered. However, the explosive gunpowder could be dangerous and cause injury.

(3) The bullet-loaded guns also have an appearance similar to that of the real guns and discharge the bullet when triggered. It has been well known that such toy guns can blind or deafen a person if his eye or ear is struck by the bullet.

The present invention is directed to overcoming the above shortcomings encountered by the prior art.

SUMMARY OF THE INVENTION

It is therefore an object of the present invention to provide a toy submachine gun being safe but stimulating.

It is further an object of the present invention to provide a toy submachine gun which is more amusing to a child.

According to the present invention, a toy submachine gun includes a body housing having a magazine housing and a pistol grip, a electric contact contacting with a plate spring when the trigger is triggered, a reduction gear assembly driving a rotating arm having an eccentrical shaft reciprocatingly guided in a groove provided in the body housing, a striking plate spring capable of engaging with the rotating arm so that each time after they interengage it will strike a sound box so as to produce sound, and a casing reciprocatingly mounted on the body housing and housing the motor contained therein the motor, the reduction gear assembly, and the rotating arm mounted therein.

The present invention may best be understood through the following description with reference to the accompanying drawings, in which:

DETAILED DESCRIPTION OF THE PREFERRED EMBODIMENT

Figure 1:
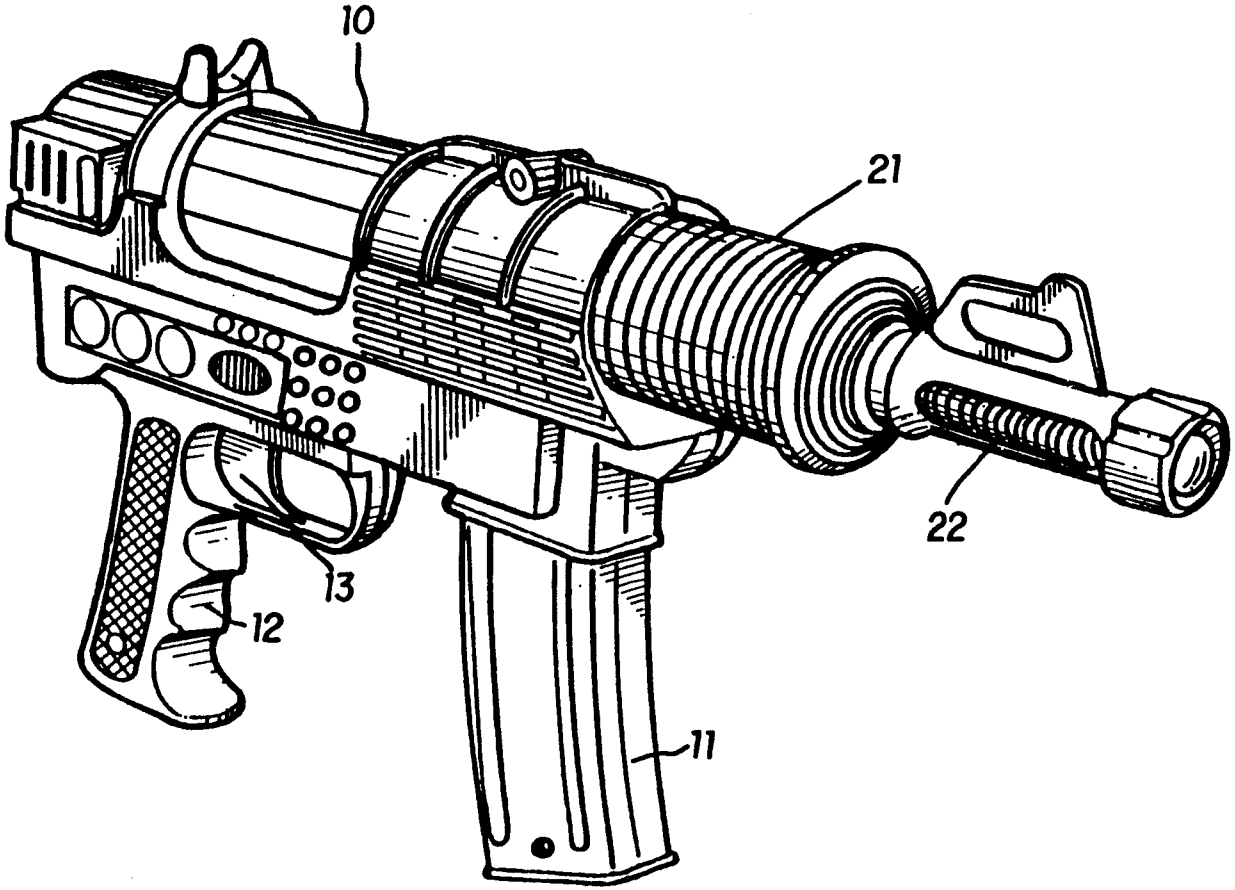
FIG.1 is a perspective view showing a toy submachine gun according to the present invention.
Figure 2:
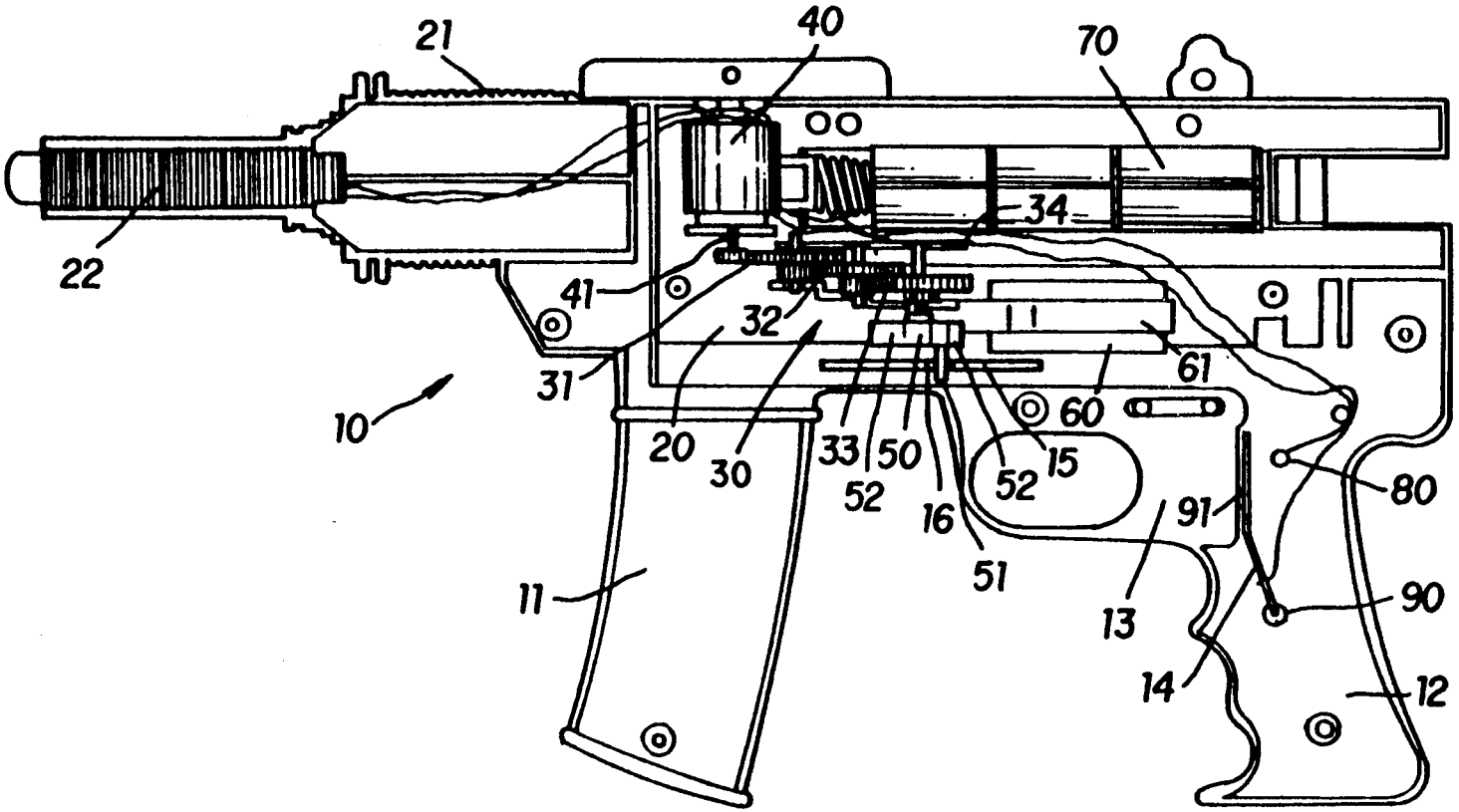
FIG.2 is a longitudinally sectional view showing the toy submachine gun in FIG. 1.
Figure 3:
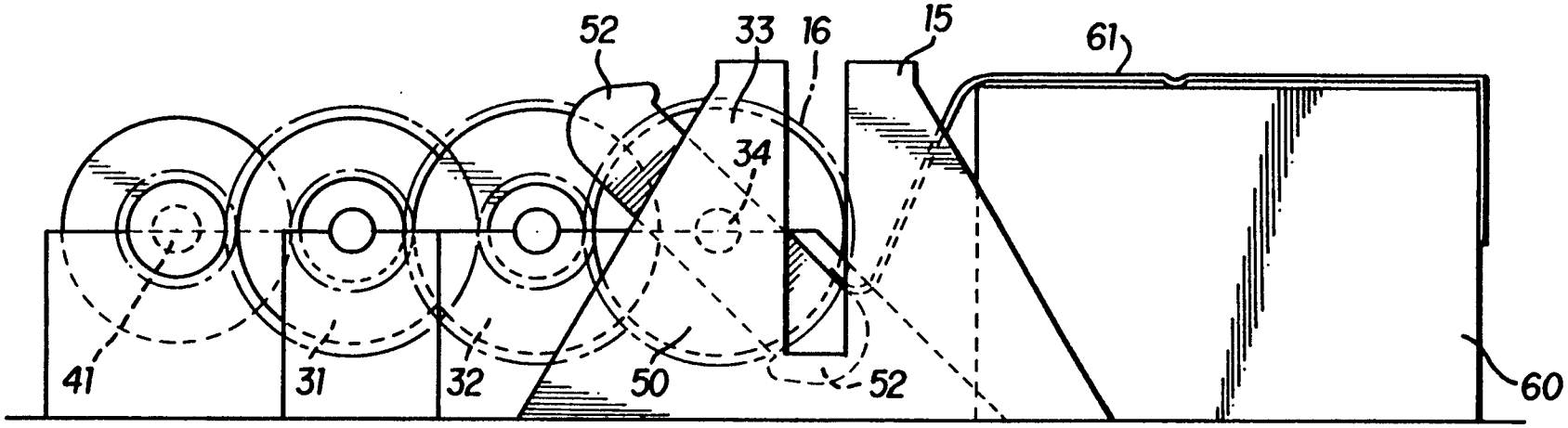
FIG.3 is a schematic view showing a positional relationship among a reduction gear assembly, a rotating arm, a shaft mounting, a sound box and a striking plate spring of a toy submachine gun according to the present invention.

As shown in FIGS. 1-3, a toy submachine gun according to the present invention includes a body housing 10, and casing 20 reciprocatingly mounted on housing 10. A sound box 60, a set of batteries 70 and a motor 40 driving a reduction gear assembly 30 driving a rotating arm 50 are mounted in casing 20. Body housing 10 is symmetrical to a longitudinal vertical plane of the casing 20 and includes a magazine housing 11, a pistol grip 12, and a trigger 13. The trigger 13 is arranged to urge contact 91 of a plate spring 14 mounted on a point 90 in pistol grip 12 against an electric contact 80, when the trigger 13 is squeezed. This causes the plate spring 14 to energize motor 40 by completing the electrical circuit created by plate spring 14, batteries 70, contact 80, and motor 40.

Casing 20 is connected to a wrinkled sleeve 21 coaxially extending therefrom a barrel 22. Reduction gear assembly 30 is driven by a shaft 41 of motor 40 and has an intermeshing gear set form by gears 31, 32 and 33. Gear 33 has an extension shaft 34 for rotating arm 50 which has an eccentrical shaft 51 reciprocatingly received in a groove 16 within a shaft mounting 15 mounted in body housing 10. A striking plate spring 61 is contained in casing 20 and capable of engaging with rotating arm 50 so that after each time striking plate spring 61 and rotating arm 50 engage, spring 61 is released so as to strike sound box 60 causing a sound. Barrel 22 can have a lighting medium (not shown) mounted therein which is electrically connected to batteries 70, so that when trigger 13 is triggered, the lighting medium will light intermittently ligh.

The operation of the present toy sub-machine gun is as follows:

When trigger 13 is squeeze, the two ends 52 of rotating arm 50 alternately engage with striking plate spring 61 enabling sound box 60 to produce a shooting sound, and the lighting medium in barrel 22 lights intermittently. Since eccentrical shaft 51 is only reciprocatingly slidable in groove 16, rotating arm 50 will cause casing 20 mounting and elements 30-70 to mounted therein to move reciprocatingly relative to body housing 10, which provides a vibrating feeling for the use of the toy submachine gun. When trigger 13 is released, plate spring 14 disengages from contact 80, so that rotating arm 50 stops rotating and the lighting medium in barrel 22 stops lighting.

It is to be noted that by the use of eccentric shaft 51 and groove 16, the rotation of rotating arm 51 is transformed into the reciprocating movement or the harmonic motion of casing 20. By the well known two formulas for the harmonic motion, i.e. $V=wr\sin\theta$ and $a=w^2r\cos$, it can be readily understood that the acceleration of casing 20 is the largest at two reciprocating limits thereof, so as to bestow a vibrating effect on body housing 10. Furthermore, the fact that elements 21 and 22 and elements 30-70 all are mounted on or in casing 20 is based on the recognition that a weight-added casing 20 will have a relatively larger inertia, which in turn will allow body housing 10 to have a relatively larger reaction force to strengthen the vibrating or shooting feeling for the user of the toy submachine gun.

In sum, when trigger 13 is squeeze, the lighting medium in barrel 22 lights intermittently striking plate spring 61 strikes sound box 60 to providing a shooting sound, and weight-added casing 20 provides a shooting feeling. All of these effects are achieved at no sacrifice of the safety of the toy submachine gun.

Through the above description, it should now become readily apparent how and why the present invention can achieve the objects it contemplates.

What I claim is:

1. A toy submachine gun comprising:

a body housing having a magazine housing and a pistol grip;

a trigger movably connected to said pistol grip;

a plate spring mounted in said body housing and urging against said trigger;

a contact contacting with said plate spring when said trigger is triggered, and mounted in said body housing;

a motor electrically connected to said contact and said plate spring to be energized when said trigger is triggered;

a reduction gear assembly driven by said motor and having an extension shaft;

a rotating arm driven by said shaft and having an eccentrical shaft;

a groove provided in said body housing and capable of reciprocatingly guiding therein said eccentrical shaft;

a sound box;

a striking plate spring capable of engaging with said rotating arm so that each time after said striking plate spring and said arm engage, said striking plate spring will strike said sound box to sound; and a casing reciprocatingly mounted on said body housing, and mounting therein said motor, said reduction gear assembly and said rotating arm.

2. A toy submachine gun accoring to claim 1, wherein said sound box and said striking plate spring are mounted in said casing.

3. A toy submachine gun according to claim 1, further comprising a shaft mounting mounted in said body housing and provided with said groove.

4. A toy submachine gun according to claim 1, wherein said casing connects thereto a wrinkled sleeve coaxially extending therefrom a barrel.

* * * * *